US010486950B2

(12) United States Patent
Karleskint et al.

(10) Patent No.: US 10,486,950 B2
(45) Date of Patent: Nov. 26, 2019

(54) DOWN STOP INDICATOR FOR VEHICLE LIFT

(71) Applicant: Gray Manufacturing Company, Inc., St. Joseph, MO (US)

(72) Inventors: Raymond W. Karleskint, Clarksdale, MO (US); Stephen J. Rucker, Savannah, MO (US)

(73) Assignee: Gray Manufacturing Company, Inc., St. Joseph, MO (US)

( * ) Notice: Subject to any disclaimer, the term of this patent is extended or adjusted under 35 U.S.C. 154(b) by 377 days.

(21) Appl. No.: 14/568,852

(22) Filed: Dec. 12, 2014

(65) Prior Publication Data

US 2016/0016768 A1 Jan. 21, 2016

Related U.S. Application Data

(60) Provisional application No. 62/025,250, filed on Jul. 16, 2014.

(51) Int. Cl.

| | |
|---|---|
| ***B66F 17/00*** | (2006.01) |
| ***B66F 7/28*** | (2006.01) |
| *B66F 3/46* | (2006.01) |

(52) U.S. Cl.

CPC ..... *B66F 7/28* (2013.01); *B66F 17/00* (2013.01); *B66F 3/46* (2013.01)

(58) Field of Classification Search

CPC .... B66F 17/00; B66F 3/46; B66F 7/28; B66F 9/0755

USPC ..... 254/133 R, 2 B; 187/207, 208, 209, 210, 187/247; 269/17

See application file for complete search history.

(56) References Cited

U.S. PATENT DOCUMENTS

| | | | | | |
|---|---|---|---|---|---|
| 2,805,839 | A | | 9/1957 | Branick | |
| 4,131,263 | A | * | 12/1978 | John | B66F 5/04 254/8 B |
| 4,252,217 | A | * | 2/1981 | Benjamin | B65G 1/0414 187/234 |
| 4,328,951 | A | * | 5/1982 | Laupper | B66F 7/04 187/208 |
| 4,334,667 | A | * | 6/1982 | Fox | B66F 5/04 251/251 |
| 4,411,582 | A | * | 10/1983 | Nakada | B66F 9/24 187/222 |
| 4,531,614 | A | * | 7/1985 | Naegeli | B66F 7/04 187/208 |

(Continued)

FOREIGN PATENT DOCUMENTS

| | | | |
|---|---|---|---|
| EP | 1285878 | A1 | 2/2003 |
| EP | 2708489 | A1 | 3/2014 |
| WO | 2004/026754 | A2 | 4/2004 |

*Primary Examiner* — Joseph J Hail
*Assistant Examiner* — Arman Milanian
(74) *Attorney, Agent, or Firm* — Hovey Williams LLP

(57) ABSTRACT

A down stop indicator for a vehicle lift. The vehicle lift includes a main housing, a carriage assembly for receiving a wheel of a vehicle, a lift actuator for vertically raising and lowering the carriage assembly relative to the main housing, and down stop. The down stop can be selectively positioned in either an engaged position or an unengaged position. With the down stop in the engaged position, the down stop restricts the lift actuator from vertically lowering. The indicator is configured to indicate a position of the down stop.

15 Claims, 10 Drawing Sheets

(56) References Cited

U.S. PATENT DOCUMENTS 4,599,034 A * 7/1986 Kennedy ..... B66F 7/025 254/89 R
4,825,977 A 5/1989 Isogai
4,856,618 A * 8/1989 Isogai ..... B66F 7/04 187/208
4,949,540 A 8/1990 Wich
5,009,287 A 4/1991 Starr
5,015,146 A * 5/1991 Barnes ..... B66F 7/02 187/221
5,025,512 A * 6/1991 Niimura ..... E04H 4/065 187/360
5,207,297 A * 5/1993 Beattie ..... B66F 7/04 187/208
5,362,196 A 11/1994 Beattie
5,484,134 A * 1/1996 Francis ..... B66F 7/04 254/2 B
5,497,854 A * 3/1996 Fang ..... B66B 5/26 187/209
5,638,387 A * 6/1997 Palleggi ..... B60L 7/14 318/67
5,803,206 A * 9/1998 Halstead ..... B66F 7/04 187/208
5,911,408 A * 6/1999 Berends ..... B66F 7/04 254/2 B
6,182,798 B1 * 2/2001 Brady ..... B66B 9/0853 187/200
6,186,280 B1 * 2/2001 Healy ..... B66F 7/04 187/207
6,279,685 B1 * 8/2001 Kogan ..... B66F 7/20 187/203
6,315,079 B1 * 11/2001 Berends ..... B66F 3/46 187/203
6,382,358 B1 * 5/2002 Kritzer ..... B66F 7/04 187/208
6,634,461 B1 * 10/2003 Baker ..... B66F 3/46 187/210
6,897,388 B2 * 5/2005 Greer ..... H02B 3/00 200/200
6,964,322 B2 11/2005 Green et al.
6,983,196 B2 * 1/2006 Green ..... B66F 7/04 254/45
7,150,073 B2 12/2006 Stewart
7,168,904 B1 * 1/2007 Perkins ..... E04H 6/42 187/203
7,199,534 B2 * 4/2007 Ford ..... B66F 3/46 254/418
7,207,419 B2 * 4/2007 Fore ..... B66F 17/003 187/203
7,219,770 B2 * 5/2007 Baker ..... B66F 3/46 187/210
7,334,664 B2 * 2/2008 Fäßer ..... B66F 7/16 187/208
8,083,034 B2 * 12/2011 Bordwell ..... B66F 3/46 187/210
8,141,850 B2 * 3/2012 Drake ..... B66F 5/02 254/134
8,256,577 B2 * 9/2012 Kritzer ..... B66F 3/46 187/215
8,474,793 B2 * 7/2013 Penenburgh ..... B66F 3/18 254/134
8,567,761 B2 10/2013 De Jong et al.
8,947,251 B2 * 2/2015 Finkbeiner ..... B66F 7/28 187/210
9,061,872 B2 * 6/2015 Finkbeiner ..... B66F 3/46
9,249,000 B2 2/2016 Finkbeiner
2002/0175319 A1 * 11/2002 Green ..... B66F 7/04 254/45
2004/0011594 A1 1/2004 Stewart
2006/0115353 A1 * 6/2006 Berends ..... B66F 3/46 414/458
2006/0151247 A1 * 7/2006 Raffler ..... B66F 7/12 187/208
2007/0096068 A1 * 5/2007 Finkbeiner ..... B66F 3/46 254/45
2009/0173923 A1 * 7/2009 De Jong ..... B66F 7/16 254/2 C
2009/0183955 A1 * 7/2009 Gonzalez Rodil .... B66B 5/0081 187/404
2009/0236183 A1 * 9/2009 Bordwell ..... B66F 3/46 187/234
2009/0242333 A1 * 10/2009 Finkbeiner ..... B66F 3/46 187/209
2010/0066278 A1 * 3/2010 De Jong ..... B66F 7/16 318/376
2011/0037041 A1 * 2/2011 DeJong ..... B66F 3/46 254/89 R
2011/0097187 A1 4/2011 Kelley et al.
2011/0278517 A1 * 11/2011 Deuring ..... B66F 7/065 254/122
2012/0018255 A1 * 1/2012 Gross ..... B66F 7/28 187/207
2012/0032126 A1 * 2/2012 Finkbeiner ..... B66F 7/28 254/133 R
2012/0181494 A1 * 7/2012 Guyard ..... B66F 3/00 254/385
2013/0240300 A1 * 9/2013 Fagan ..... B66F 3/46 187/210
2013/0240812 A1 * 9/2013 Helmich ..... B66F 3/46 254/89 H
2014/0161568 A1 * 6/2014 De Jong ..... B66F 3/00 414/21
2014/0324214 A1 * 10/2014 Elliott ..... B66F 13/00 700/213
2015/0139764 A1 * 5/2015 Jang ..... B60S 9/04 414/458
2015/0232310 A1 8/2015 Jaipaul
2015/0329336 A1 * 11/2015 Brown ..... B66F 7/28 254/89 H
2016/0016768 A1 1/2016 Karleskint et al.

* cited by examiner

DOWN STOP INDICATOR FOR VEHICLE LIFT

CROSS-REFERENCE TO RELATED APPLICATIONS

This non-provisional patent application claims priority to U.S. Provisional Patent Application Ser. No. 62/025,250, filed Jul. 16, 2014, and entitled "DOWN STOP INDICATOR FOR VEHICLE LIFT." The entire disclosure of the above-identified provisional patent application is incorporated by reference in this non-provisional patent application.

BACKGROUND

1. Field of the Invention

The present invention relates generally to vehicle lift systems. More particularly, the invention concerns a down stop for a vehicle lift system and a down stop indicator capable of alerting a user of the vehicle lift system as to an engagement status of the down stop.

2. Description of the Prior Art

The need to lift a vehicle from the ground for service work is well established. For instance, it is often necessary to lift a vehicle for tire rotation or replacement, steering alignment, oil changes, brake inspections, exhaust work, and other automotive maintenance. Traditionally, lifting a vehicle has been accomplished through the use of equipment that is built-into a service facility, such as either lift units with hydraulic actuator(s) installed below the surface of the floor or two and four-post type lift systems installed on the floor surface. These built-in units are located at a fixed location at the service facility and adapted to engage a vehicle frame to lift the vehicle from the ground.

In an effort to increase the versatility and mobility of lift devices and to reduce the need to invest in permanently mounted lifting equipment, devices commonly known as a mobile column lifts (MCLS) have been developed. Prior MCL systems often employed safety down stops to selectively prevent the vehicle lifts from vertically actuating downward when in use. As such, the safety down stops act as safety features by ensuring that the lifts are restricted from unsafe vertical movement. For instance, if an MCL system has been used to vertically lift a vehicle and a user is working under the lifted vehicle, with the safety down stops of the lifts engaged, the user can be assured that the lifts will not vertically lower the vehicle while the user is underneath the vehicle or underneath the lifts. Nevertheless, safety down stops on prior MCL systems are generally integrated internally, within the housings of the lifts or on a front-side of the lifts. As such, it may not be readily apparent to users of such MCL systems as to whether the safety down stops are engaged or disengaged and/or whether the vehicle will inadvertently lower while the user is underneath it.

An example of a prior art vehicle lifts included in such MCL systems is the prior art vehicle lift 22 illustrated in FIGS. 1-3. The vehicle lift 22 illustrated in FIG. 1-3 is similar to vehicle lifts described in U.S. Patent App. Publ. No. 2013/0240300, which is incorporated herein by reference in its entirety. The prior art vehicle lift 22 broadly includes a base 30, a post 32, a carriage assembly 34, a lift actuator 36, and a main housing 38. The base 30 supports the lift 22 on the floor or the ground. The post 32 is rigidly coupled to the base 30 and extends upwardly therefrom. The carriage assembly 34 is configured to engage a wheel of a vehicle and is vertically shiftable relative to the post 32. The lift actuator 36 is received in the post 32 and is operable to vertically raise and lower the carriage assembly 34 relative to the post 32 and the base 30. With emphasis on FIG. 1, the main housing 38 is attached to the post 32 and encloses many of the components of that make up the control and power systems of the lift 22. The main housing 38 may also include a removable access panel 40 for providing access to various components of the lift's 22 control and power systems.

It is noted that prior art lifts, such as lift 22 illustrated in FIGS. 1-3, generally include a plurality of down stop lugs 42 positioned on a front-side of the lift 22. As used herein the phrase "front-side" refers to a vehicle-facing side of a lift, whereas a phrase "back-side" refers to a non-vehicle-facing side of a lift. As is perhaps best illustrated in FIG. 3, the down stop lugs 42 are generally configured to engage with a down stop catch assembly 44 associated with the carriage assembly 34. As such, when the carriage assembly 34 is raised vertically, the down stop catch assembly 44 can consecutively engage with the spaced apart down stop lugs 42 on the front-side of the lift 22. Because the down stop lugs 42 and catch assembly 44 are positioned on the front-side (i.e., the vehicle-facing side) of the lift 22, it may not be readily apparent whether or not the down stop catch assembly 44 is engaged with the down stop lugs 42, particularly when the lift 22 is lifting a vehicle and the vehicle interferes with a view of the front-side of the lift 22. Furthermore, manufacturing down stop lugs 42 and the catch assembly 44 on the front-side of the lifts, such as illustrated on the prior art lift 22 of FIGS. 1-3, is difficult, time-consuming, and expensive.

Accordingly, there remains a need for a vehicle lift system with a down stop indicator that is easily viewable by a user of the lift system, such that a user of the lift system can readily determine whether the down stop is engaged or disengaged.

SUMMARY OF THE INVENTION

In one embodiment of the present invention, there is provided a vehicle lift comprising a main housing, a carriage assembly configured for receiving a wheel of a vehicle, a lift actuator configured to vertically raise and lower the carriage assembly relative to the main housing, and a down stop configured to be selectively positioned in either an engaged position or an unengaged position. With the down stop in the engaged position, the down stop is configured to restrict the lift actuator from vertically lowering. The vehicle lift further comprises an indicator for indicating a position of the down stop.

In another embodiment of the present invention, there is provided a process for controlling a vehicle lift having a down stop and an indicator that indicates a position of the down stop. The process includes an initial step of receiving instructions to vertically raise the lift. A next step includes engaging the down stop so as to restrict the lift from being vertically lowered. The process includes a next step of providing an indication, via the indicator, that the down stop has been engaged. A next step includes lifting the lift in response to the instructions received. A next step includes receiving instructions to vertically lower the lift. The process includes a next step of disengaging the down stop so as to allow the lift to be vertically lowered. A next step includes providing an indication, via the indicator, that the down stop has been disengaged. A final step includes lowering the lift in response to the instructions received.

DETAILED DESCRIPTION OF THE PREFERRED EMBODIMENTS

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
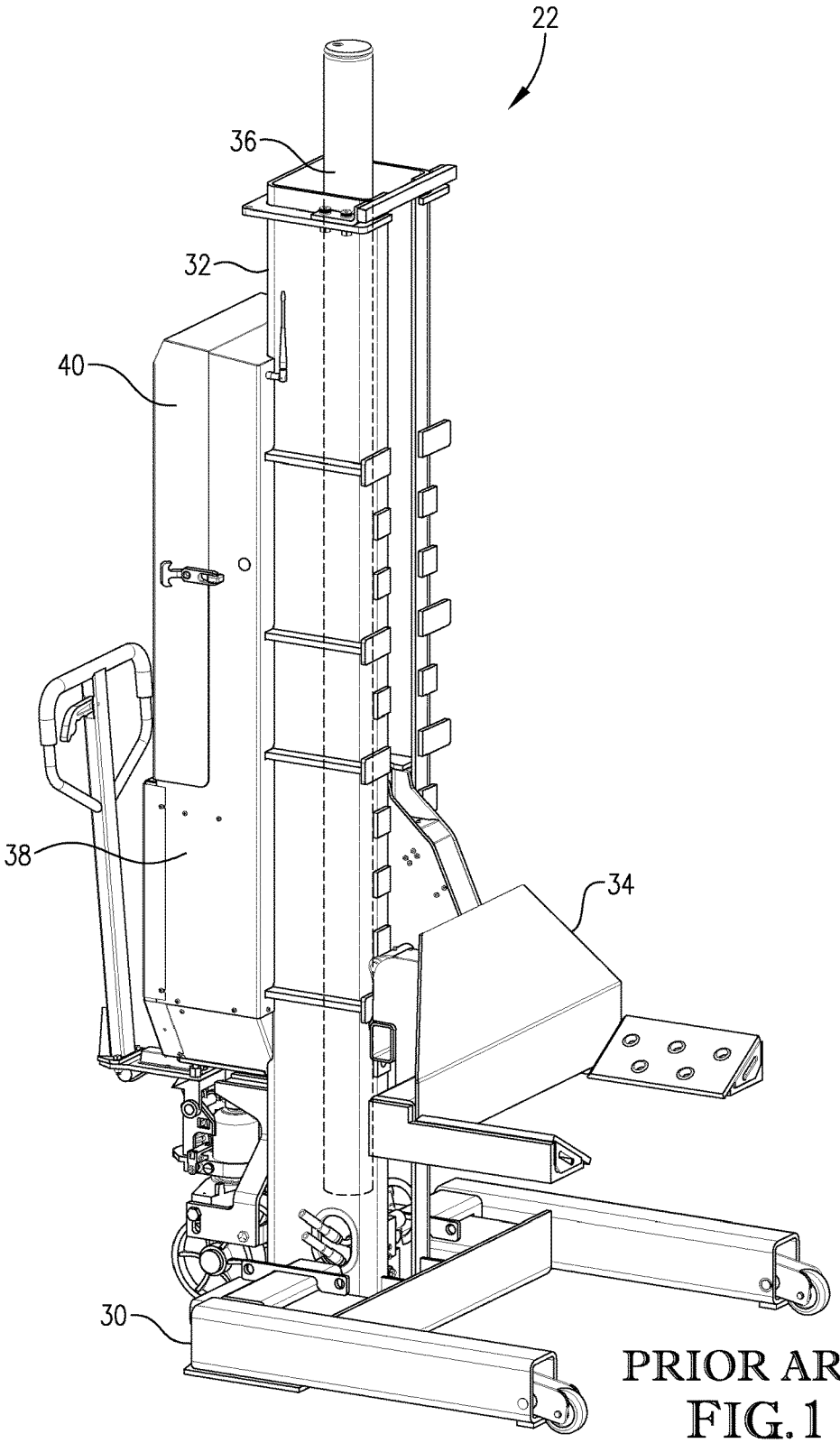
PRIOR ART FIG. 1
FIG. 1 is a perspective view showing a front-side of a prior art vehicle lift, illustrating components of a down stop positioned on the front-side of the vehicle lift.
Figure 2:
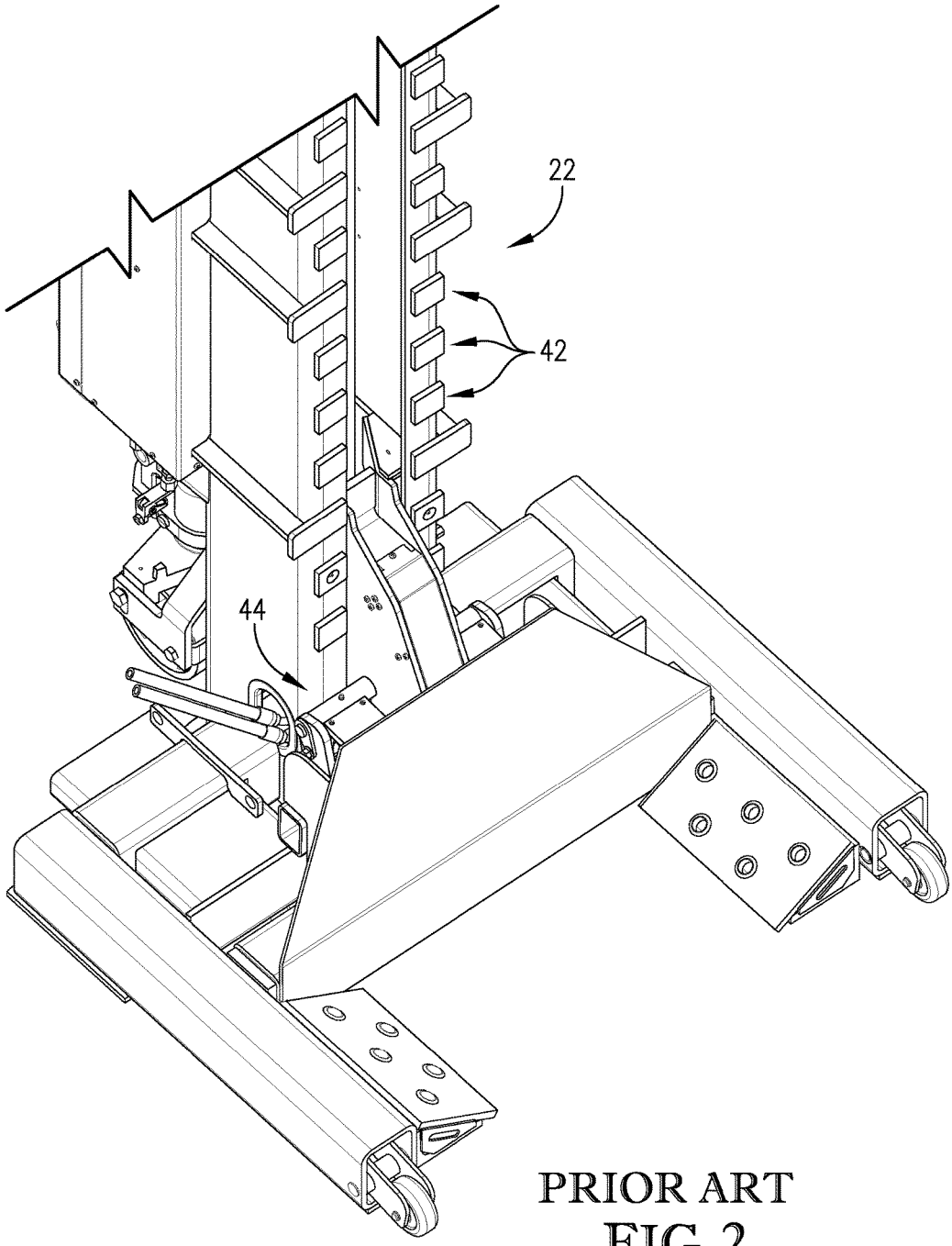
PRIOR ART FIG. 2
FIG. 2 is a partial perspective view of a bottom portion of the prior art vehicle lift from FIG. 1, illustrating components of the down stop.
Figure 3:
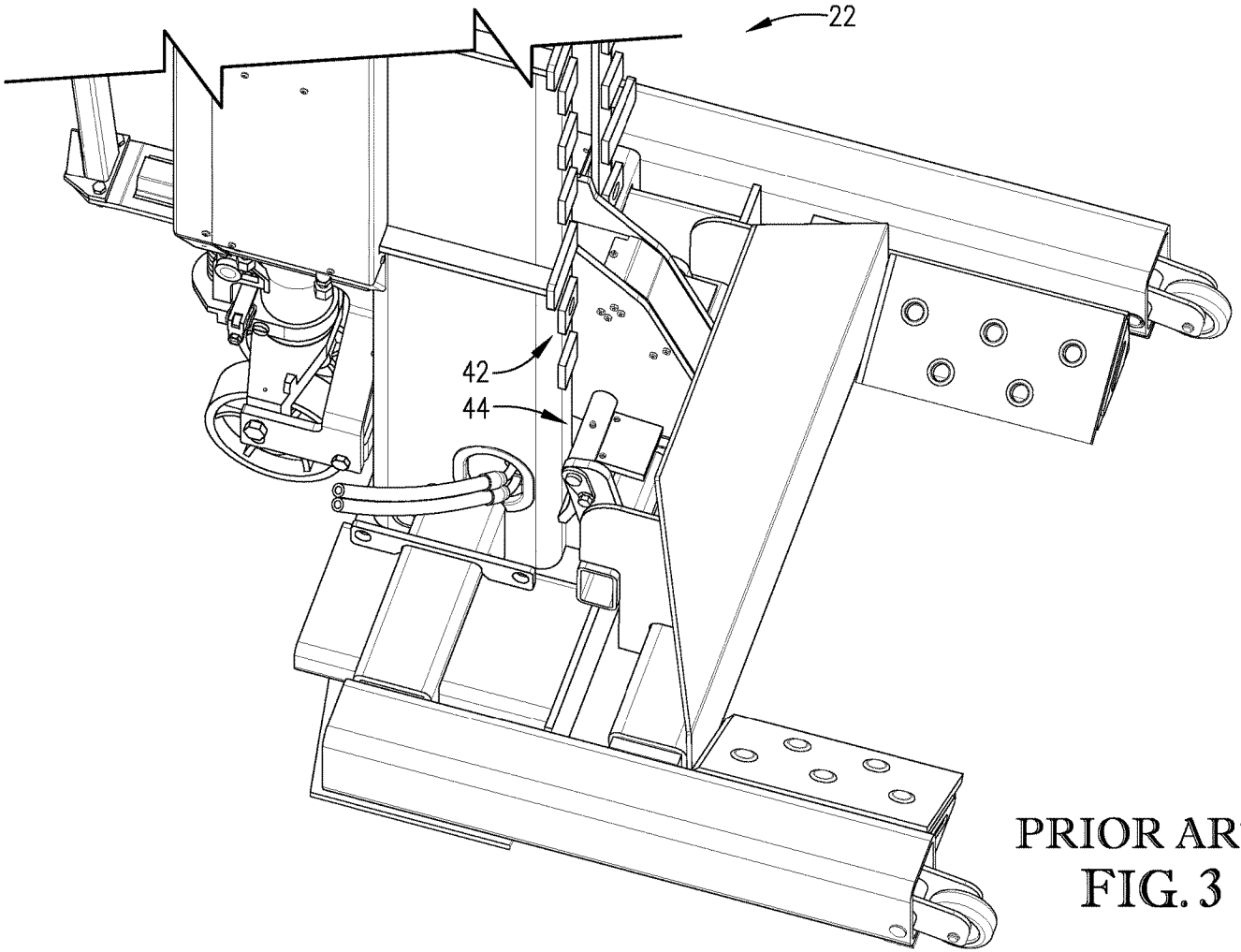
PRIOR ART FIG. 3
FIG. 3 is an additional partial perspective view of the bottom portion of the prior art vehicle lift form FIGS. 1-2, illustrating the components of the down stop.

Embodiments of the present invention are directed to vehicle lifts that are similar, in many respects, to the vehicle lift 22 illustrated in FIGS. 1-3. In particular, and with reference to FIG. 4, embodiments of the present invention comprise a vehicle lift 52 that broadly includes a base 60, a post 62, a carriage assembly 64, a lift actuator 66, and a main housing 68. As with lift 22, the base 60 supports the lift 52 on the floor or the ground. The post 62 is rigidly coupled to the base 60 and extends upwardly therefrom. The carriage assembly 64 is configured to engage a wheel of a vehicle and is vertically shiftable relative to the post 62. The lift actuator 66 is received in the post 62 and is operable to vertically raise and lower the carriage assembly 64 relative to the post 62 and the base 60. Further, the main housing 68 is attached to the post 62 and encloses many of the components of that make up the control and power systems of the lift 62. The main housing 68 may also include a removable access panel 70 for providing access to various components of the lift's 52 control and power systems.

The vehicle lift 52 will generally include a lift control system that is comprised of one or more processors and memory elements operable to control and/or direct the functionality of the vehicle lift 52. For example, the memory elements may have stored thereon, one or more computer programs that instruct the processor to perform steps necessary for the vehicle lift 52 to operate according to automated instructions or according to instructions provided by a user. The vehicle lift 52 may also include an electrical power supply for powering the lift, which may broadly comprise one or more rechargeable batteries. Furthermore, the vehicle lift 52 may include a hydraulic power system for raising and lowering the lift actuator 66, which may broadly comprise a hydraulic reservoir and a hydraulic pump.

Figure 4:
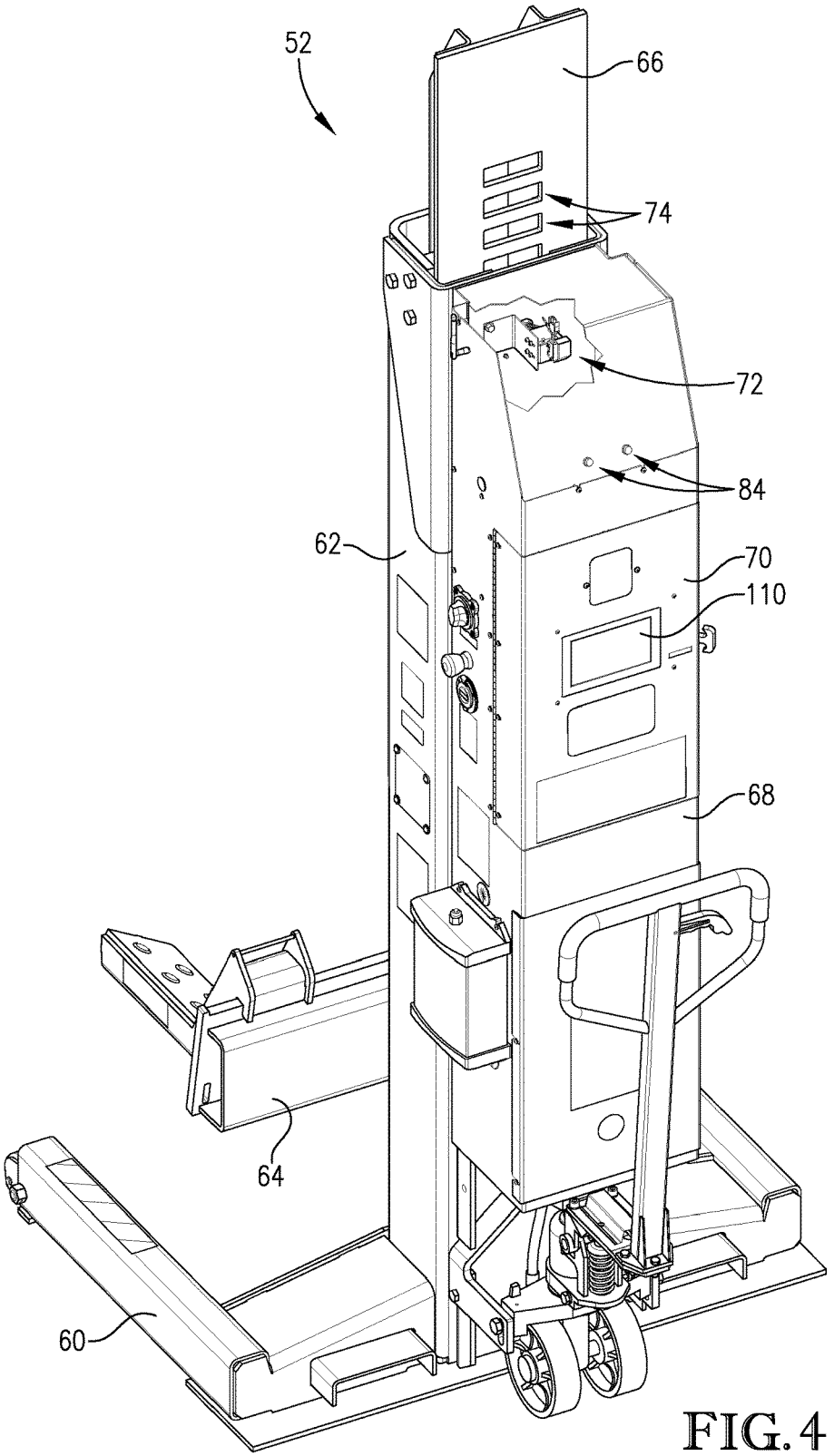
FIG. 4 is a perspective view showing a back-side of a vehicle lift according to embodiments of the present invention, illustrating components of a down stop and indicators located on a back-side of the vehicle lift.

Although FIG. 4 depicts a single lift 52, it is understood that any combination of two or more lifts can be used as part of an MCL system. For example, an MCL system can employ two, four, six, eight, or generally any number of individual lifts 52. In certain embodiments, each of the vehicle lifts 52 in the MCL system will be substantially identical. It should also be understood that the lifts 52 are not limited for use with vehicles, but also may be used to raise or lower other objects relative to a floor or ground surface, such as aircraft, industrial machinery, shipping containers, construction subassemblies, and the like.

Figure 5:
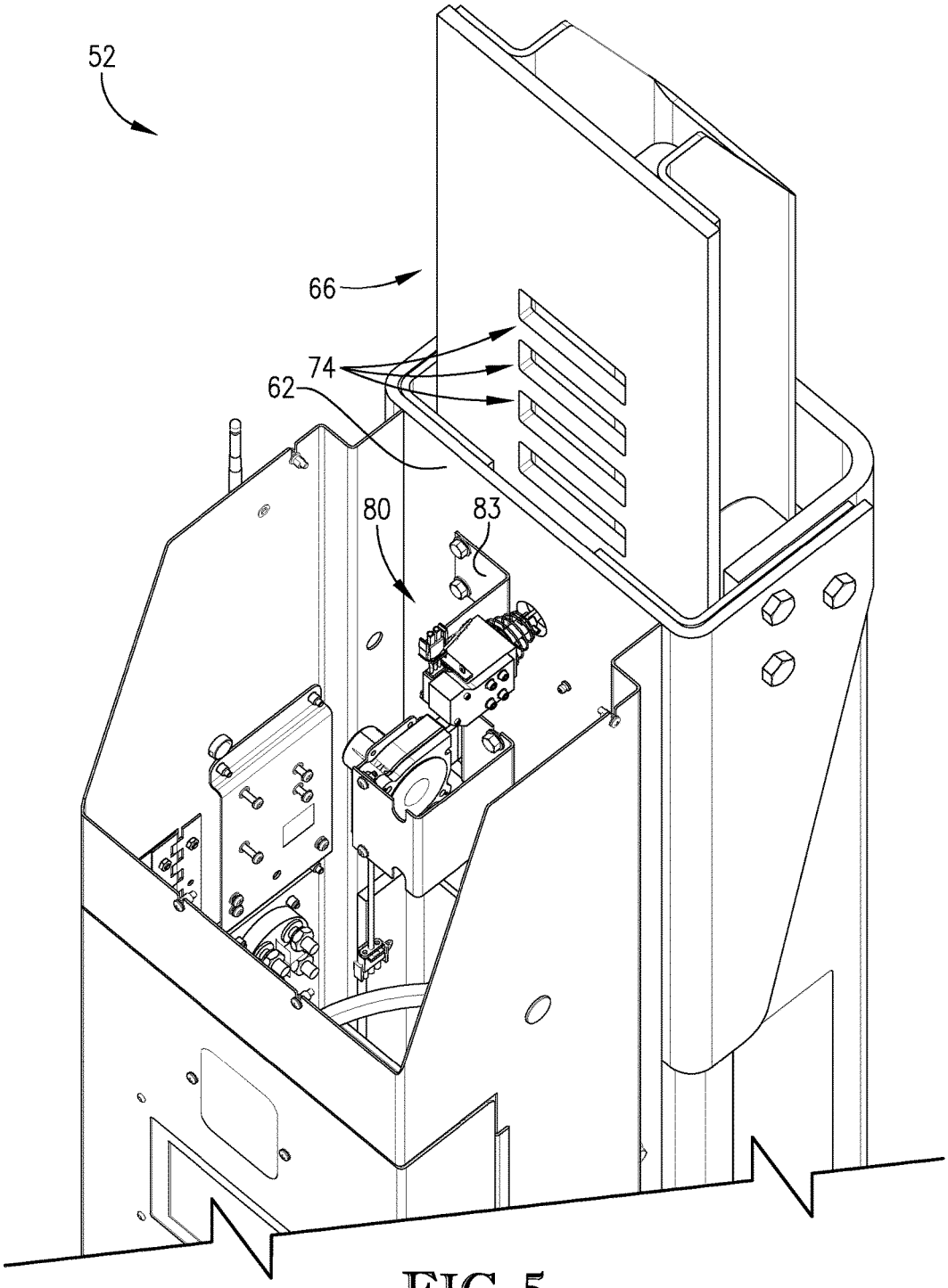
FIG. 5 is a partial perspective view of a top portion of the vehicle lift from FIG. 4, with a portion of a housing of the vehicle lift removed to illustrate the down stop in more detail.

Embodiments of the present invention are able to overcome the above-described issues related to down stops used on previously-used vehicle lifts, such as the prior art lift 22 of FIGS. 1-3, through use of a down stop 72 that is operable to engage with a plurality of vertically-spaced locking holes 74 formed on a back-side (i.e., a non-vehicle-facing side) of the lift actuator 66, as illustrated in FIGS. 4-5. In more detail, the lift actuator 66 of the lift 52 is formed with a generally flat back side surface. As such, the locking holes 74 are formed through an entire thickness of the back side. The plurality of locking holes 74 are formed along at least a portion of a height of the back side of the lift actuator 66 and are each generally aligned along a vertical axis. Each of the locking holes 74 will have a size that permits the locking holes 74 to receive a portion of the down stop 72, which is described in more detail below.

Figure 6:
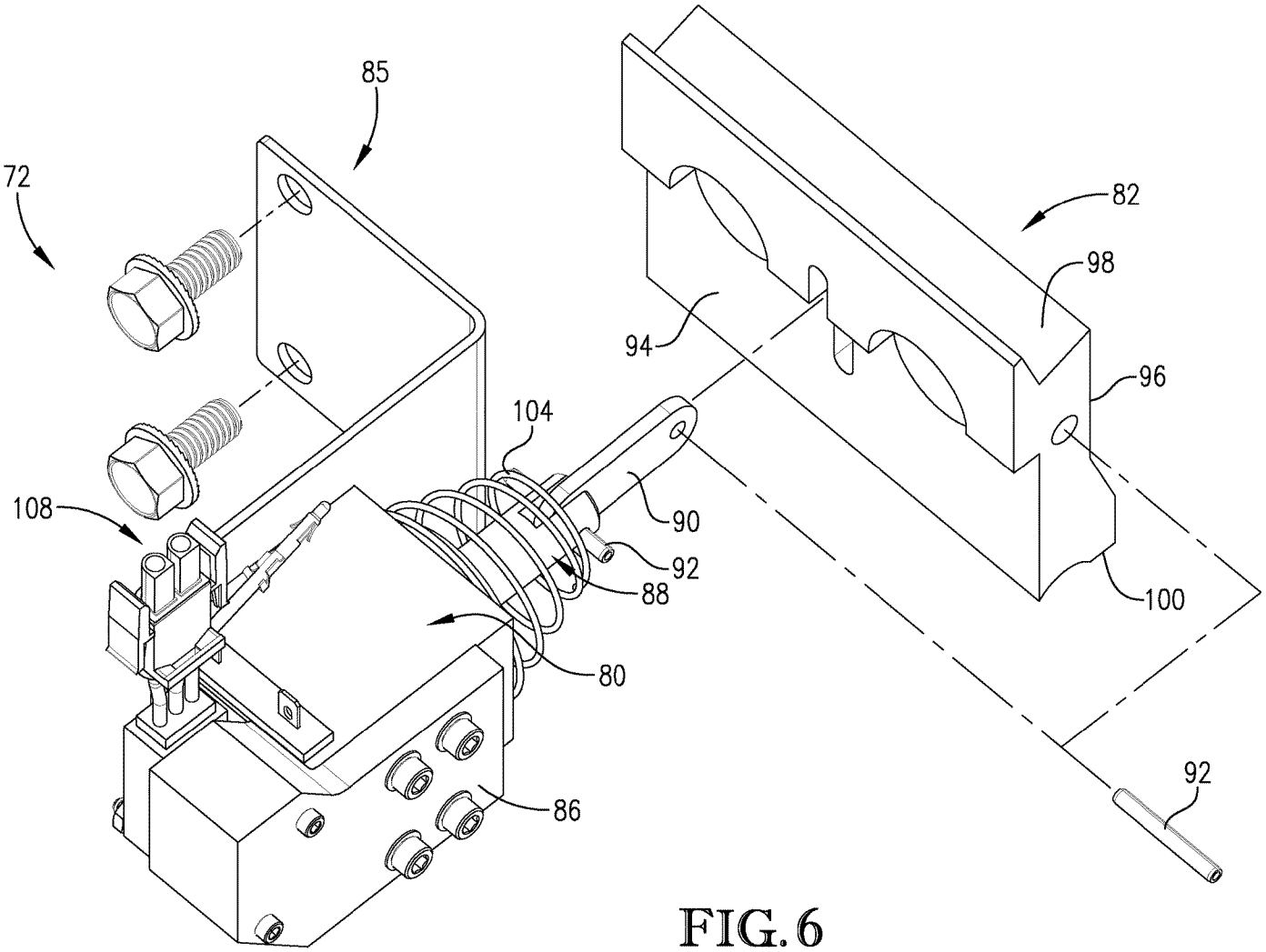
FIG. 6 is an exploded view of the down stop from the vehicle list of FIGS. 4-5.
Figure 7:
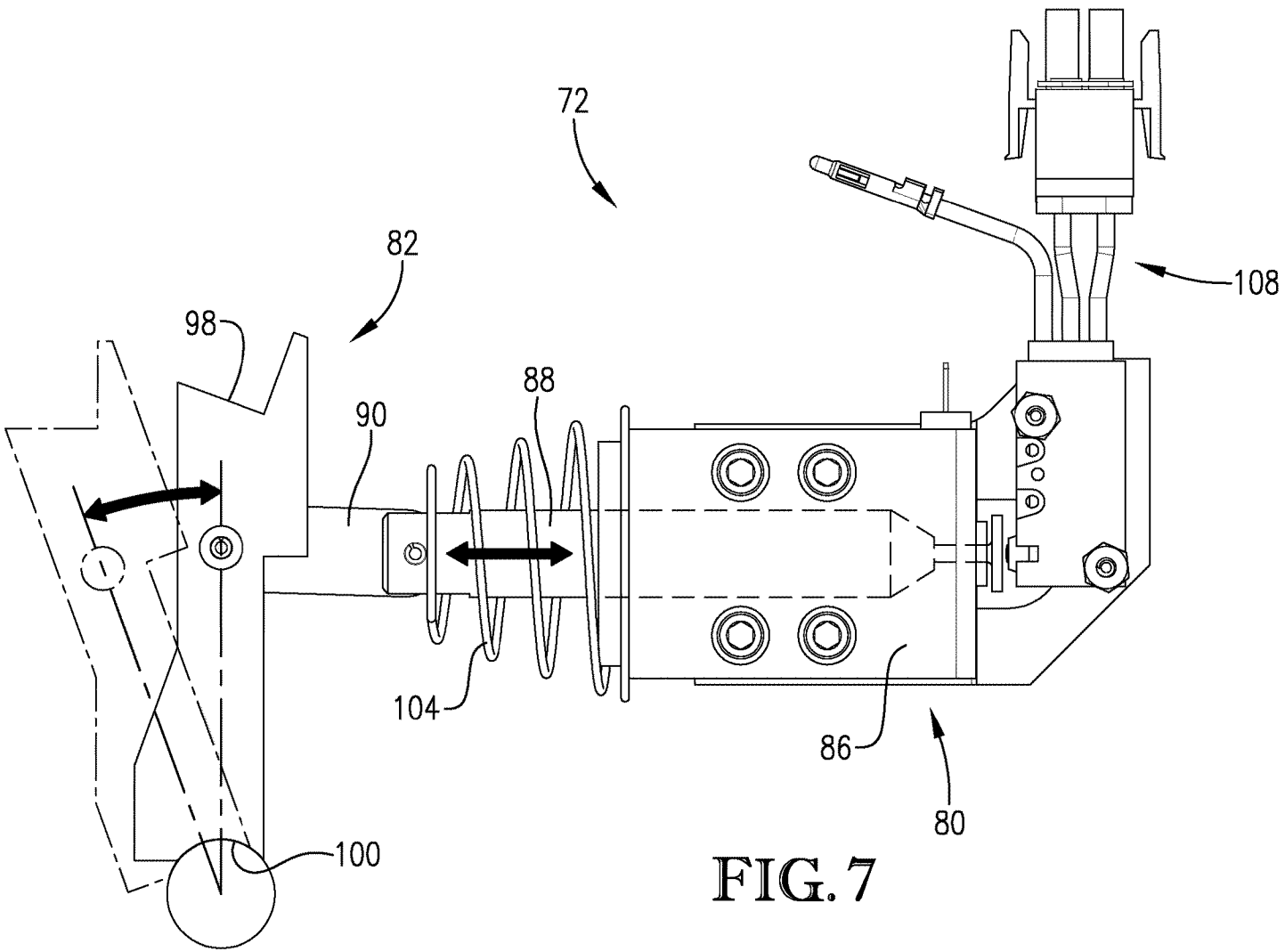
FIG. 7 is a side elevational view of the down stop from FIG. 6.

Turning to the down stop 72, which is perhaps best illustrated in FIGS. 6-7, the down stop 72 broadly comprising a linear actuator 80 and a pawl 82, with the linear actuator 80 configured to be selectively positioned in either a retracted, unengaged position or an extended, engaged position, such that the pawl 82 can be either unengaged or engaged, respectively, with one of the locking holes 74. As illustrated by FIG. 5, the down stop 72 may be secured in place to the lift 52, via a bracket 83, which holds the down stop 72 securely in place against a portion of the post 62. The bracket 83 may be secured in place via nut and bolt combination, weld, or other standard method of attachment. In certain embodiments, the linear actuator 80 will comprise a solenoid 86 and a plunger 88, with the solenoid configured to selectively position the plunger 88 in either a retracted, unengaged position or an extended, engaged position. In some embodiments, the pawl 82 will be secured to an end of the plunger 88 via a linkage arm 90.

As will be described in more detail below, with the plunger 88 of the linear actuator 80 in the engaged position, the pawl 82 is configured to engage with one of the vertically-spaced locking holes 74 of the lift actuator 66 so as to restrict the lift actuator 66 from vertically lowering. Furthermore, as perhaps is best shown in FIG. 4, the down stop 72 may include, or may be otherwise associated, with one or more indicators 84, which are electrically coupled to the linear actuator 80. The indicators 84 are configured to indicate a position of the down stop 72 and/or linear actuator 80 (i.e., a position of the solenoid 86 and/or plunger 88), so as to indicate whether the pawl 82 is configured to be engaged or unengaged with one of the locking holes 74.

With reference to FIG. 6-7, the solenoid 86 of the linear actuator 80 may comprise a mechanical, electrical, hydraulic, pneumatic, or other similar-type actuator operable to generate linear motion of the plunger 88. The plunger 88 may comprise a shaft or a rod that can be extended or retracted by the solenoid 86. In certain embodiments, the pawl 82 is connected to the plunger 88 via the linkage arm 90 which may be a shaft, a rod, or other similar extension piece. The linkage arm 90 may be secured to each of the pawl 82 and the plunger 88 via pivot pins 92, which provide for the components to pivot about the pins 92.

The pawl 82 may comprise a generally rectangular piece of material. Because the pawl 82 may be required to support at least a portion of the weight of a vehicle that is to be lifted via the vehicle lift 52, the pawl 82 should preferable be formed from a material having high strength and durability, such as high-strength steel. As mentioned above, the pawl 82 may be sized to correspond with the locking holes 74 of the lift actuator 66. In particular, the pawl 82 will be sized such that at least a portion of the pawl 82 is configured to be received with the locking holes 74.

The pawl 82 will include a back side 94 that faces the linear actuator 80 and a front side 96 that faces away from the linear actuator 80. A top portion of the back side 94 is separated from a top portion of the front side 96 via a top side 98, while a bottom portion of the back side 94 is separated form a bottom portion of the front side 96 via a bottom side 100. As shown in the drawings, some embodiments provide for the top side 98 to be formed with a notch shape. As will be described in more detail below, the notch shape provides for the top side 98 of the pawl 82 to securely engage with a top edge of the lift actuator 66 material that defines each of the plurality of locking holes 74. In some embodiments, the bottom side 100 of the pawl 82 will be configured to engage a support component 102 of the lift 52. As illustrate in FIGS. 8-9, the support component 102 may be permanently secured to the post 62, such as via high-strength weld. In some embodiments the support component 102 may be a circular rod. In such embodiments, at least a portion of the bottom side 100 of the pawl 82 may have a concave shape, such that the bottom side 100 can correspondingly engage with the support component 102. Furthermore, in embodiments in which the support component 102 has the form of the circular rod, the pawl 82 is configured to rotate about the support component 102 to selectively engage and disengage from the locking holes 74.

Figure 8A:
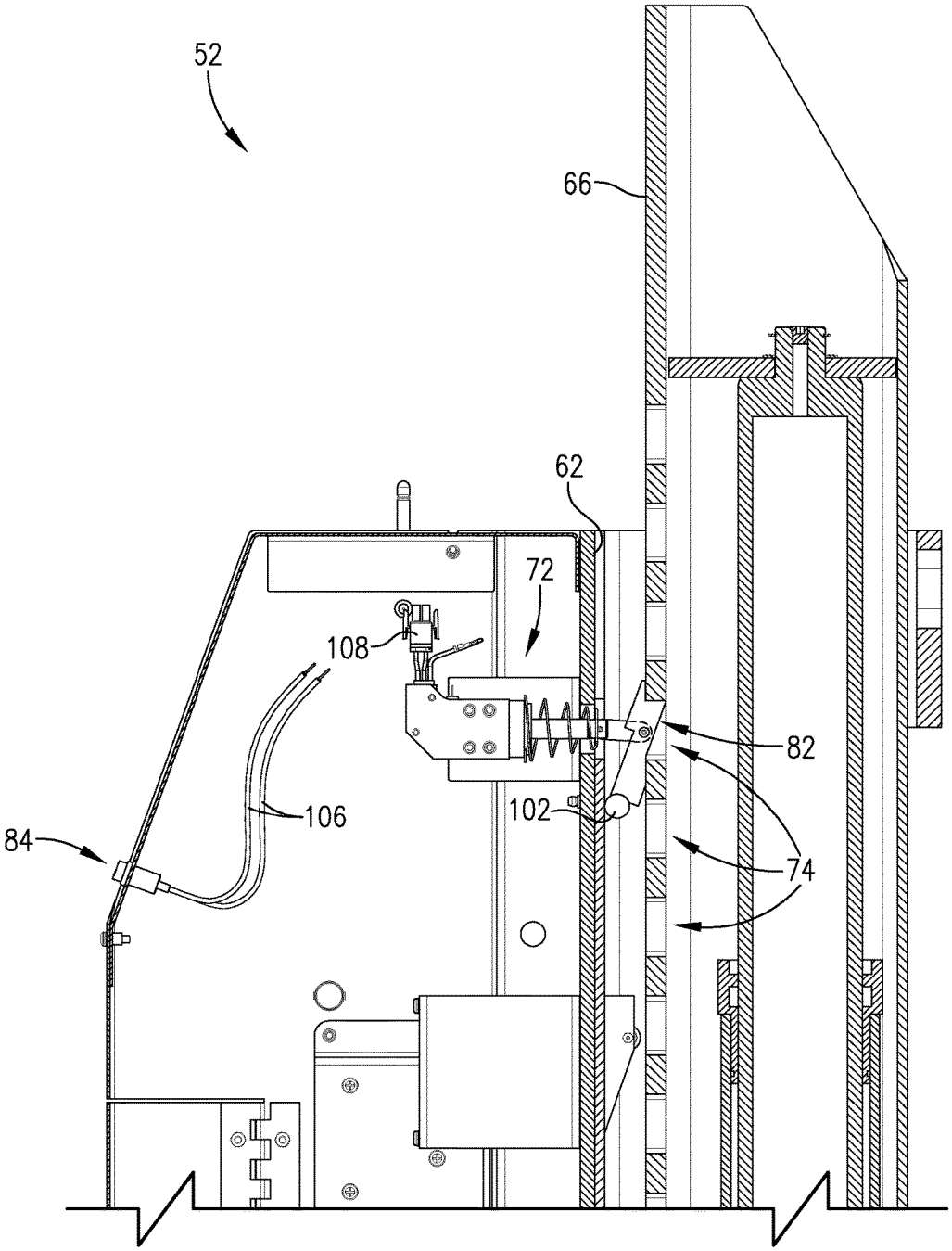
FIG. 8*a* is a side elevational cross-section view of the vehicle lift of FIGS. 4-5, with the down stop in the engaged position and showing a pawl of the down stop engaged with a locking hole of a lift actuator.
Figure 8B:
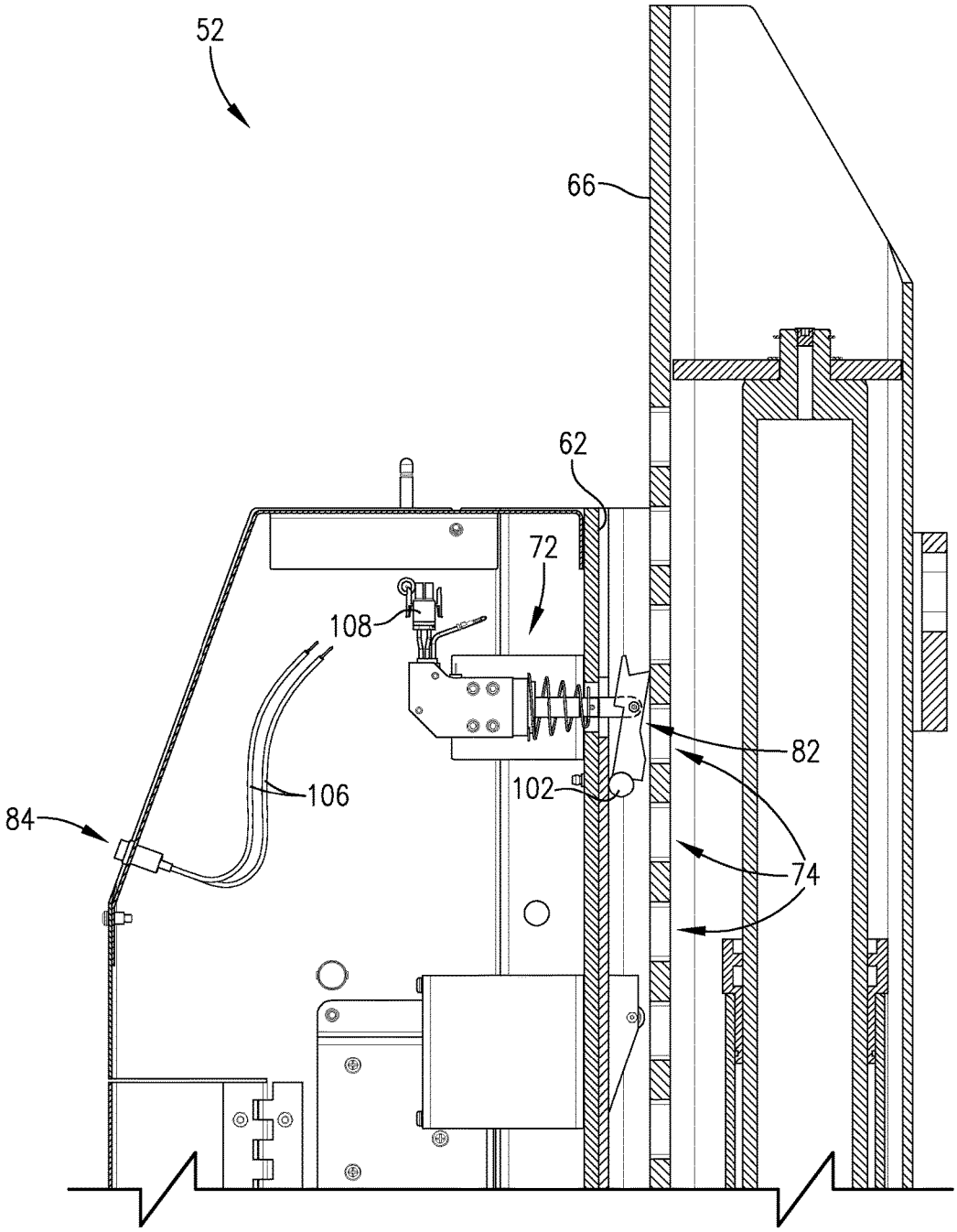
FIG. 8*b* is a side elevational cross-section view of the vehicle lift of FIGS. 4-5 and 8*a*, with the down stop in the engaged position and showing the pawl of the down stop forced from engagement with the locking hole of the lift actuator.

In operation of the vehicle lift 52, the pawl 82 of the down stop 72 is configured to engage with one of the locking holes 74 on the back-side (i.e., the non-vehicle-facing side) of the lift actuator 66 so as to prevent the lift actuator 66 from vertically lowering. In particular, and with reference to FIGS. 8-9, as the lift actuator 66 is being vertically lifted, the linear actuator 80 will be actuated in the engaged position such that the pawl 82 will be forced into consecutive engagement with each of the locking holes 74 that travel past the pawl 82. In more detail, with the pawl 82 engaged with a particular locking hole 74, such as illustrated in FIG. 8*a*, the lift actuator 66 will be allowed to continue to raise. Specifically, and with reference to FIG. 8*b*, as the lift actuator 66 is rising, a bottom edge of the lift actuator 66 material that defines the specific locking hole 74 will come into contact with the front side 96 of the pawl 82, so as to force the pawl 82 out of the particular locking hole 74 towards the linear actuator 80. In some embodiments, as illustrated in in the figures, the down stop 72 will include a biasing spring 104 that biases the pawl 82 into engagement with the locking holes 74. As such, with the pawl 82 engaged with the specific locking hole 74, an upward movement of the lift actuator 66 will cause the bottom edge of the lift actuator 66 material that defines the specific locking hole 74 to force the pawl 82 back against the bias spring 104 so that the lift actuator 66 can continue to be vertically raised. The pawl 82 will remain forced back until it is aligned with the next, consecutive locking hole 74, at which time the pawl 82 will be forced by the biasing spring 104 into engagement with such next, consecutive locking hole 74. As such, as the lift actuator 66 is being vertically raised, the pawl 82 will consecutively engage with each adjacent locking hole 74 of the lift actuator 66.

Once engaged with a locking hole 74, the pawl 82 will restrict the lift actuator 66 from vertical lowering. Specifically, as illustrated by FIG. 8*a*, with the pawl 82 received within the a specific locking hole 74, the top side 98 of the pawl 82 will be engaged with a top edge of the lift actuator 66 material that defines the specific locking hole 74. Additionally, the bottom side 100 of the pawl 82 will be engaged with the support component 102 that is permanently secured to the post 62. As such, the lift actuator 66 is restricted by the pawl 82 from vertically lowering. Nevertheless, as described above, the lift actuator 66 can continue to be raised to an intended height. Once the lift actuator 66 has reached its intended height, the lift 52 will be shifted to a parked configuration, where it is neither being raised or lowered. In such a parked configuration, the pawl 82 will remain within an adjacent locking hole 74 to restrict the lift actuator 66 from vertically lowering.

Figure 9:
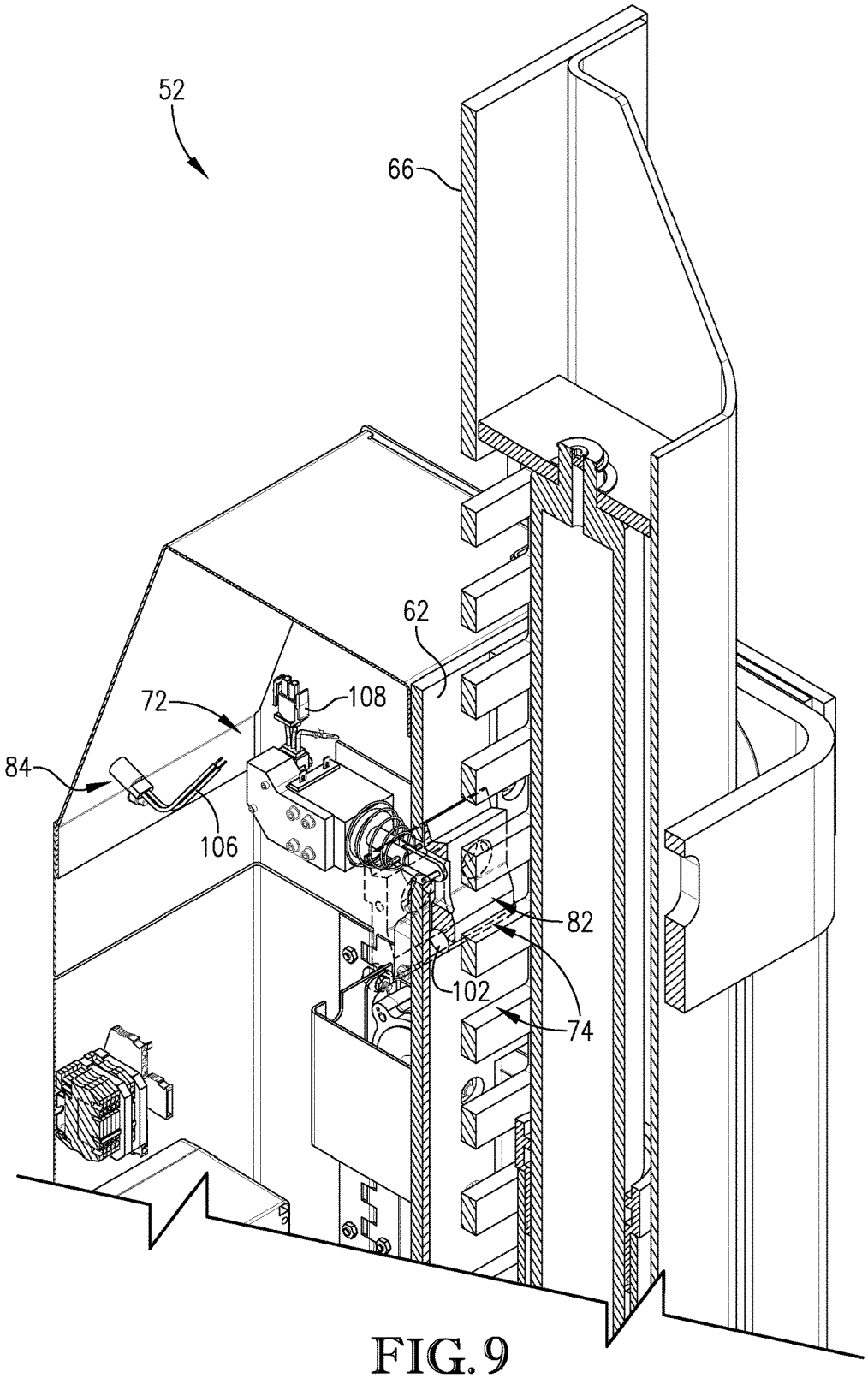
FIG. 9 is perspective cross-section view of the vehicle lifts of FIGS. 4-5, with the down stop in the unengaged position.

To lower the lift actuator 66 after it has been raised, the down stop 72 will be disengaged, such that the linear actuator 80 retracts and/or disengages the pawl 82 from one of the locking holes 74. In particular, the pawl 82 will be retracted such that a back side of the pawl 82 is positioned adjacent to the post 62, as illustrated in FIG. 9. In such a configuration, the lift actuator 66 is free to be vertically lowered, or raised, without restriction by the down stop 72.

As shown in the figures, and particularly in FIG. 4, the down stop 72 may be positioned on the lift 52, such that it is spaced vertically apart from the base 60 of the lift 52. In particular, the down stop 72 may be positioned such that the pawl 82 is capable of being engaged with each of the locking holes 74 of the lift actuator 66 as the lift actuator 66 is raised vertically to various heights. As such, with the lift actuator 66 completely lowered, i.e., in a stowed position, the down stop 72 may be positioned on the lift 52 at a position generally adjacent to an uppermost locking hole 74. Similarly, with the lift actuator 66 raised to its maximum height, the down stop 72 may be adjacent to a lowermost locking hole 74. In some alternative embodiments, the lift 52 may include a plurality of down stops 72 positioned vertically along a height of the lift 52.

Embodiments of the present invention provide for the indicator 84 of the vehicle lift 52 to indicate whether the down stop 72, and particularly the linear actuator 80, and/or the plunger 88 of the linear actuator 80, is in the engaged or disengaged position. In some embodiments, the indicator 84 will comprise one or more lighting elements, such as incandescent bulbs, florescent bulbs, high-intensity discharge bulbs, or LEDs. In other embodiments, the indicator 84 may also, or alternatively, comprise auditory alarms, such as speakers, buzzers, or the like. In embodiments in which the indicator 84 comprises lighting elements, the indicator 84 may include two or more lighting elements. The indicator 84 may comprise a first lighting element that is activated to provide an indication of the down stop 72 being in the engaged position and a second lighting element that is activated to provide an indication of the down stop 72 being in the unengaged position. In some embodiments, the first lighting element may be green and the second lighting element may be red. In other embodiments, the first lighting element may be red and the second lighting elements may be green. Still other embodiments may provide for the lighting elements to be other colors. For example, the first lighting element may be green and the second lighting element may be yellow or orange. In alternative embodiments, the indicator 84 may comprise a single lighting element that is operable to illuminate in different colors, such as multi-color capable LEDs. As such, the indicator 84 may illuminate a first color when the down top 72 is in the engaged position and a second down stop 72 is in the unengaged position.

To allow for the indicator 84 to indicate a position of the down stop 72, the indicator 84 may be coupled with the linear actuator 80, and specifically with the solenoid 86 of the linear actuator 80, via electrically conductive cables or wires 106, such as shown in FIG. 9. In some embodiments, the down stop 72 may include one or more electrical connectors 108, which facilitate the connection between the wires 106 and the linear actuator 80. As such, when the down stop 72 is the engaged position, the wires 106 can provide a signal from the linear actuator 80 to the indicator 84 to instruct the indicator 84 to indicate that the down stop 72 is in the engaged position. Alternatively, when the down stop 72 is in the unengaged position, the wires 106 can provide a signal from the linear actuator 80 to the indicator 84 to instruct the indicator 84 to indicate that the down stop is in the unengaged position. In other embodiments, the indicator 84 may be in communication with the linear actuator 80 wirelessly. As such, the indicator 84 can be positioned spaced apart from the linear actuator 80, if necessary.

Embodiments of the present invention provide for the indicator 84 of the vehicle lift 52 to be positioned on the housing 68 of the lift 52, such that a user of the lift 52 can readily observe a status of the down stop 72 as indicated by the indicator 84. As such, and as illustrated in FIG. 4, the indicator 84 may be positioned on the housing 68 at a position that is generally consistent with an average human eye-level of a user of the lift 52. However, the indicator 84 may be positioned at other locations on the housing 68 of the lift 52, as may be required or preferred.

As previously described, with the linear actuator 80 in the engaged position, the pawl 82 is configured to engage with a locking hole 74 of the lift actuator 66 to thereby restrict the lift actuator 66 from being vertically lowered. Contrastingly, with the linear actuator 80 in the disengaged position, the pawl 82 is configured to not engage with the locking holes 74 so as to not restrict the lift actuator 66 from being vertically lowered. As such, and with the indicator 84 configured to indicate a position of the down 72, if the down stop 72 is disengaged, a user can observe the indication of such disengagement as provided by the indicator 84, such that the user can immediately know to use caution when working under/around the lift 52 and/or a vehicle that is being lifted by the lift 52. Alternatively, if the down stop 72 is engaged, a user can observe the indication of such engagement as provided by the indicator 84, such that the user can immediately know that the lift 52 is in a safe configuration for working around the lift 52 and/or a vehicle that is being lifted by the lift 52.

In addition to embodiments in which the indicators 84 are lighting elements, embodiments of the present invention may provide for textual prompts to be associated with the lighting elements. For example, the first lighting element that is associated with the down stop 72 being in the engaged position may have an associated textual prompt stating: "Down Stop Engaged—Lift Ready to be Raised and/or Parked." Alternatively, the second lighting element that is associated with the down stop 72 being in the disengaged position may have an associated textual prompt stating: "Down Stop Disengaged—Lift Ready to be Lowered." Such textual prompts may, in some embodiments be in the form of placards positioned on the housing 68 of the lift 52. In other embodiments, the textual prompts may be displayed on a graphical user interface (GUI) associated with the lift control system, which is described in more detail below. Nevertheless, such textual prompts may assist in providing an interpretation of the status of the down stop 72 as indicated by the indicator 84.

In some embodiments, the down stop 72 will be manually activated, such as by a switch, push-button, or other similar manual component associated with the vehicle lift 52. In other embodiments, the down stop 72 will be automatically activated. For example, as previously described, the vehicle lift 52 will include the lift control system for controlling various functions and features of the lift 52. As such, lift control system of the vehicle lift 52 will control the vehicle lift 52 in response to operator (i.e., user) commands. In some embodiments, the lift control system will include, as illustrated in FIG. 4, a lift control module 110 that acts as a user interface for the lift control system. The lift control module 110 may include graphic display, such as a cathode ray tube, liquid crystal display, plasma, or touch screen that is operable to display visual graphics, images, text, etc. In certain embodiments, the lift control module 110 facilitates interaction and communication through the graphic display. The GUI enables the user to interact with the graphic display by touching or pointing at display areas to provide information to the lift control module 110 and the lift control system. For instance, the GUI may include a touchscreen in the form a capacitive digitizer, a resistive digitizer, or the like. As such, in some embodiments, the down stop 72 can be controlled by the lift control module 110. In additional embodiments, the indicator 84 of the down stop 72 may be displayed as an alert or an icon presented on the graphic display of the lift control module 110.

In some embodiments, the lift control module 110 may communicate with the down stop 72 through various networks, with such networks being wired or wireless (e.g., WiFi/Bluetooth) and may include switches, wireless receivers and transmitters, and the like, as well as electrically conductive cables or optical cables. The networks may also include local, metro, or wide area networks, as well as the Internet, or other cloud networks. Furthermore, the networks may include cellular or mobile phone networks, as well as a fiber optic networks, or the like.

In certain embodiments, the vehicle lift 52 will include one or more weight sensors configured to determine an amount of weight the lift actuator 66 is supporting. For example, in some embodiments, the weight sensor may comprise a pressure sensor associated with the hydraulic system that causes the lift actuator 66 to be vertically raised. For example, as the lift actuator 66 is vertically raising a vehicle, the weight sensor will sense the portion of the vehicle's weight that is being supported by the hydraulic pump of the vehicle lift 52. Alternatively, with the vehicle lift in the park position, i.e., having the down stop 72 in the engaged configuration and the pawl 82 engaged with a locking hole 74, the down stop 72 will be supporting most or all of the vehicle weight, such that the weight sensor will sense that none, or a negligible amount, of the vehicle weight is being supported by the hydraulic system.

In some embodiments, the weight sensor will be electrically connected with the lift control system, such that the weight sensed by the weight sensor can be displayed on the graphic display of the lift control module 110. As such, the weight sensor can provide additional indications of the status of the down stop 72. For example, with the down stop 72 disengaged, the hydraulic system will be supporting weight from the vehicle and the weight sensor will indicate such (e.g., via the graphic device). Alternatively, with the down stop 72 engaged and the pawl 82 engaged in a locking hole 74 supporting the lift actuator 66, the hydraulic system will not be supporting weight of the vehicle and the weight sensor will indicated such (e.g., via the graphic device). Thus, the weight sensor can be used in conjunction with the indicator 84 to indicate a status of the down stop 72. In certain additional embodiments, the indicator 84 can provide indications of a combination of (1) the position of the down stop 72, and (2) the weight sensed by the weight sensor. For example, in embodiments in which the indicator 84 comprises two lighting elements, the first lighting element may be activated to provide an indication that the down stop 72 is in the engaged position and the weight sensor is not measuring a weight of the vehicle (e.g., a significant portion of a vehicle's weight) being supported by the hydraulic pump. Alternatively, the second lighting element may be activated to provide an indication of the down stop 72 being in the unengaged position and the weight sensor measuring a weight of the vehicle (e.g., a significant portion of a vehicle's weight) being supported by the hydraulic pump.

In additional embodiments, the indicator 84 can provide an indication of the position of the down stop 72 based entirely on the weight sensed by the weight sensor. For example, as previously described, if the weight sensor senses that the hydraulic pump is supporting a non-nominal weight, then the down stop 72 is not engaged and the lift is being used to support the weight of a vehicle. Alternatively, if the hydraulic pump is supporting only a non-nominal weight, then the down stop 72 is engaged and is being used to support the weight of the vehicle. As such, the indicator 84 can be connected directly or indirectly to the weight sensor, such that the indicator 84 can provide an indication of the position of the down stop 72 based on the weight being sensed by the weight sensor (i.e., whether or not the hydraulic pump is supporting the weight of a vehicle).

Given the vehicle lift 52, including the down stop 72 as described above, embodiments of the present invention include a process for controlling the vehicle lift 52. The process begins with receiving information indicative of instructions to vertically raise the lift 52. Such information may be received, for instance, from a user providing instruction via the lift control module 110. Next, the process includes engaging the down stop 72 so as to restrict the lift 52 from being vertically lowered. A next step includes providing an indication, via the indicator 84, that the down stop 72 has been engaged. As previously described, in some embodiments, the indicator 84 may illuminate a green light to indicate that the down stop 72 has been engaged. Thereafter, the process includes lifting the lift 52 in response to the instructions received. After vertically lifting the lift 52, the process includes receiving information indicative of instructions to vertically lower the lift 52. Next, the process may include disengaging the down stop 72 so as to allow the lift 52 to be vertically lowered. Upon disengaging the down stop 72, an indication may be provided, via the indicator 56, that the down stop 72 has been disengaged. As previously described, in some embodiments, the indicator 84 may illuminate a yellow light to indicate that the down stop 72 has been disengaged. The process may finally include lowering the lift 52 in response to the instructions received.

It is to be understood that while certain forms of the present invention have been illustrated and described herein, it is not to be limited to the specific forms or arrangement of parts described and shown.

The invention claimed is:

1. A vehicle lift comprising:

a post;

a main housing secured to said post, wherein said main housing is associated with a lift control module with a graphic display;

a carriage assembly configured to receive a wheel of a vehicle;

a lift actuator configured to vertically raise and lower said carriage assembly relative to said post;

a down stop including— a linear actuator comprising a plunger and a solenoid configured to selectively actuate said plunger between either an engaged position or an unengaged position, a pawl connected to an end of said linear actuator, wherein with said plunger in the engaged position, said pawl is configured to restrict said lift actuator from vertically lowering, wherein said down stop is enclosed within said main housing, with said down stop secured to an exterior side of said post via a bracket extending between said post and said solenoid of said down stop, wherein said down stop additionally includes a support component secured to an interior side of said post, wherein said pawl is engaged with said support component such that said pawl is configured to rotate about said support component as said plunger is actuated between the engaged position and the unengaged position, wherein a portion of said linear actuator is configured to extend through an opening in said post and into engagement with said lift actuator; and at least one lighting element electrically coupled with said solenoid via at least one conductive wire, wherein said at least one lighting element is configured to indicate a position of said plunger, wherein said at least one lighting element is positioned on an exterior of said main housing spaced apart from said graphic display of said lift control module such that said at least one lighting element is observable to a user of said vehicle lift, wherein the at least one conductive wire extends from said down stop, through an interior space of said main housing, and to said at least one lighting element.

2. The vehicle lift of claim 1, wherein said at least one lighting element comprises a first lighting element and a second lighting element, and wherein said first lighting element indicates that said plunger of said linear actuator is in the engaged position and said second lighting element indicates that said plunger of said linear actuator is in the unengaged position.

3. The vehicle lift of claim 2, wherein said first lighting element is a green lighting element and said second lighting element is a red lighting element.

4. The vehicle lift of claim 1, wherein said at least one lighting element is selected from one or more of the following: an incandescent bulb, a florescent bulb, a high-intensity discharge bulb, or a light-emitting diode.

5. The vehicle lift of claim 1, wherein said lift actuator includes a plurality of spaced apart locking holes extending down a back side of said lift actuator.

6. The vehicle lift of claim 5, wherein with said plunger of said linear actuator in the engaged position, said pawl is configured to extended within one of the locking holes so as to restrict said lift actuator from vertically lowering, and wherein with said plunger of said linear actuator in the unengaged position, said pawl is not extended within any of the locking holes so as to not restrict said linear actuator from vertically lowering.

7. A vehicle lift comprising:

a post;

a main housing secured to said post;

a carriage assembly configured to receive a wheel of a vehicle;

a lift actuator configured to vertically raise and lower said carriage assembly relative to said post;

a down stop including— a linear actuator comprising a plunger and a solenoid configured to selectively actuate said plunger between either an engaged position or an unengaged position, wherein with said plunger in the engaged position, said down stop is configured to restrict said lift actuator from vertically lowering, wherein said down stop is enclosed within said main housing, with said down stop secured to an exterior side of said post via a bracket extending between said post and said solenoid of said down stop, wherein said down stop additionally includes a support component secured to an interior side of said post, wherein said pawl is configured to rotate about said support component as said plunger is actuated between the engaged position and the unengaged position, wherein said down stop is secured to said post, with a portion of said linear actuator configured to extend through an opening in said post and into engagement with said lift actuator; and at least one lighting element electrically coupled with said solenoid via at least one conductive wire, wherein said at least one lighting element is configured to indicate a position of said plunger, wherein said at least one lighting element is positioned on an exterior of said main housing such that said at least one lighting element is observable to a user of said vehicle lift, wherein the at least one conductive wire extends from said down stop, through an interior space of said main housing, and to said at least one lighting element.

8. The vehicle lift of claim 7, wherein said at least one lighting element comprises a first lighting element and a second lighting element, and wherein said first lighting element is operable to indicate that said plunger is in the engaged position and said second lighting element is operable to indicate that said plunger is in the unengaged position.

9. The vehicle lift of claim 8, wherein said first lighting element is a green lighting element and said second lighting element is a red lighting element.

10. The vehicle lift of claim 7, wherein said vehicle lift further includes a lift control system for controlling a functionality of said vehicle lift, and wherein said lift control system includes a lift control module for receiving instructions for operating said vehicle lift.

11. The vehicle lift of claim 10, wherein the position of said down stop is controlled via the lift control module.

12. The vehicle lift of claim 10, wherein said lift control module includes a graphic display.

13. The vehicle lift of claim 12, wherein said lift control system includes a weight sensor configured to sense a weight being supported by said vehicle lift, and wherein the weight is displayed on said graphic display.

14. A vehicle lift comprising:

a post;

a main housing;

a carriage assembly configured to receive a portion of a vehicle;

a lift actuator configured to vertically raise and lower said carriage assembly relative to said post;

a down stop including— a linear actuator comprising a plunger and a solenoid configured to selectively actuate said plunger between either an engaged position or an unengaged position, wherein with said plunger in the engaged position, said down stop is configured to restrict said lift actuator from vertically lowering, wherein said down stop is enclosed within said main housing, with said down stop secured to an exterior side of said post via a bracket, wherein said down stop additionally includes a support component secured to an interior side of said post, wherein said pawl is configured to rotate about said support component as said plunger is actuated between the engaged position and the unengaged position, wherein said down stop is secured to said post, with a portion of said linear actuator configured to extend through an opening in said post and into engagement with said lift actuator;

a user interface with a graphic display for controlling operation of said vehicle lift, wherein said user interface is incorporated with said main housing; and at least one lighting element electrically coupled with said solenoid, wherein said at least one lighting element is configured to indicate a position of said plunger, wherein said at least one lighting element is positioned apart from said graphic display of said user interface, wherein said at least one lighting element is further positioned on an exterior of said main housing such that said at least one lighting element is observable to a user of said vehicle lift.

15. The vehicle lift of claim 1, wherein said support element comprises a circular rod.

* * * * *